US005193989A

United States Patent [19]

Fleury et al.

[11] Patent Number: 5,193,989

[45] Date of Patent: Mar. 16, 1993

[54] COMPRESSOR WHEEL AND SHAFT ASSEMBLY FOR TURBOCHARGER

[75] Inventors: Jean-Luc P. Fleury, Manhattan Beach; Gerald D. LaRue, Torrance; Kusumal J. Silva, Gardena; Daniel A. Gutknecht, Torrance; Martin D. Garcia, San Pedro, all of Calif.

[73] Assignee: Allied-Signal Inc., Morristown, N.J.

[21] Appl. No.: 732,857

[22] Filed: Jul. 19, 1991

[51] Int. Cl.[5] ..... F04B 17/00

[52] U.S. Cl. ..... 417/407; 416/204 A

[58] Field of Search ..... 417/405, 406, 407; 415/170.1, 230, 216.1; 416/204 A

[56] References Cited

U.S. PATENT DOCUMENTS

| | | | |
|---|---|---|---|
| 2,695,131 | 11/1954 | Price | 415/170.1 |
| 3,693,985 | 9/1972 | Dillner | 415/230 |
| 3,846,044 | 11/1974 | Shank | 417/405 |
| 3,961,867 | 6/1976 | Woollenweber | 415/170.1 |
| 4,986,733 | 1/1991 | Fleury et al. | 415/230 |

FOREIGN PATENT DOCUMENTS 716090 1/1942 Fed. Rep. of Germany .

*Primary Examiner*—Richard A. Bertsch
*Assistant Examiner*—Timothy S. Thorpe
*Attorney, Agent, or Firm*—Ken C. Decker; William N. Antonis

[57] ABSTRACT

A turbocharger includes a compressor wheel and shaft assembly in which a threaded connection is provided between the shaft and the compressor wheel. A pair of pilot surfaces on the shaft and on the compressor wheel are located on either end of the threaded sections of the shaft and compressor wheel, and are displaced radially from the threads. Accordingly, the piloting functions which assure concentricity between the shaft and compressor wheel are kept entirely separate from the attachment function provided by the threads, thereby permitting the concentricity between the compressor wheel and shaft to be held to tighter tolerances than would be possible if the threads also performed a piloting function.

10 Claims, 2 Drawing Sheets

COMPRESSOR WHEEL AND SHAFT ASSEMBLY FOR TURBOCHARGER

Figure 1:
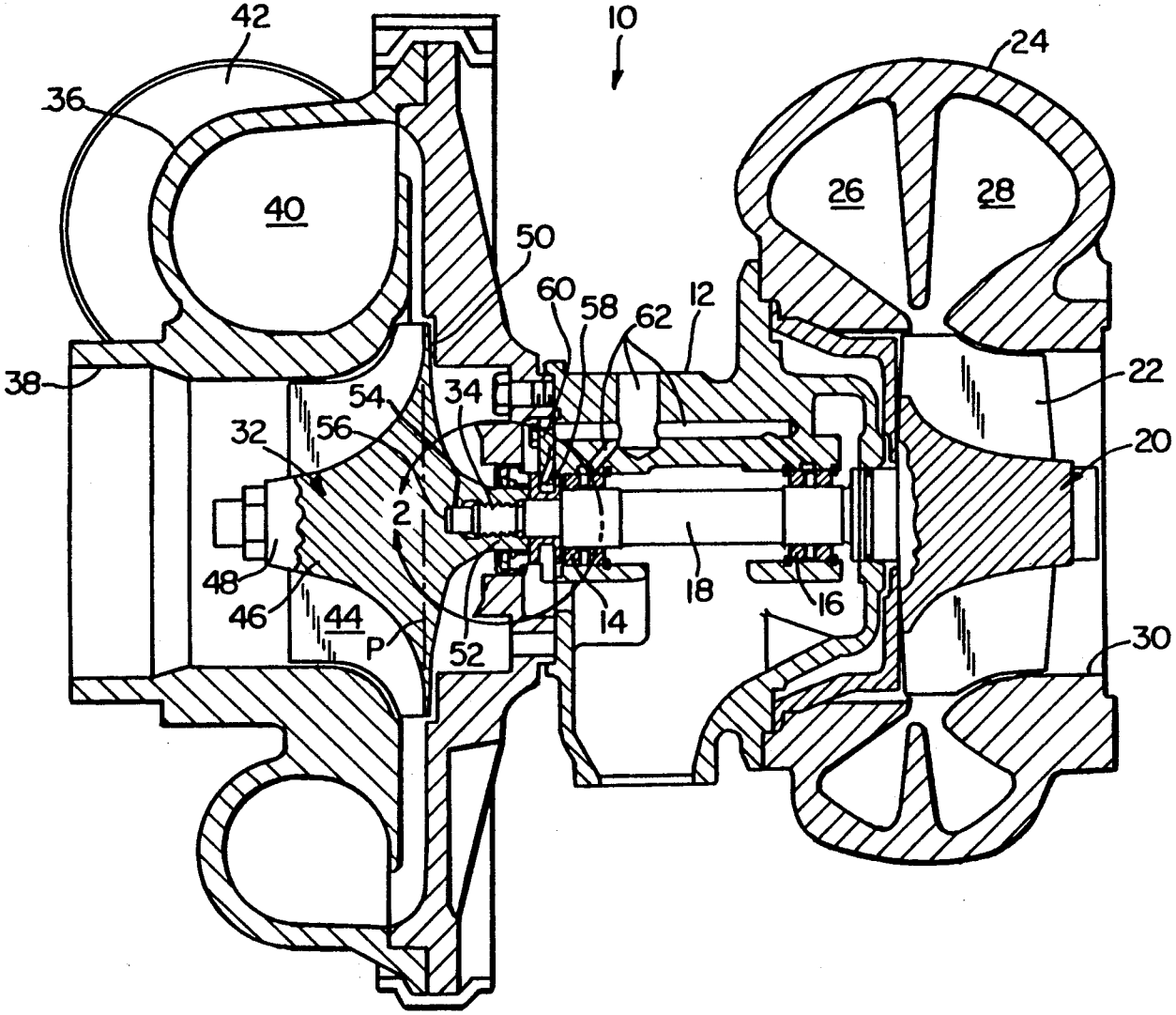

This invention relates to a so-called "boreless" compressor wheel and shaft assembly for an exhaust gas driven turbocharger.

Exhaust gas driven turbochargers, in which a turbine wheel and a compressor wheel are mounted on a common shaft so that the compressor wheel is rotated by exhaust gases passing through the turbine wheel to compress ambient air to supply charge air to the intake manifold of vehicle engine, have been known for many years. Conventional compressor wheels used in turbochargers are attached to the shaft by securing a compressor wheel against a shoulder on the shaft by engaging a nut threaded on the shaft with one end of the compressor wheel. The shaft extends through the compressor wheel.

More recently, to improve aerodynamic efficiency, compressor wheels have been designed which use blades having highly complex curvatures and which are extremely thin. These compressor wheels are made by casting a light weight material, such as aluminum. The light weight material not only permits manufacture of compressor wheels having higher efficiencies than the older compressor wheels but also reduces the rotating inertia of the rotating assembly. However, such light weight compressor wheels manufactured with a conventional bore that extends through the compressor wheel to allow conventional attachment of the compressor wheel to the shaft have exhibited low fatigue life because the bore acts as a stress riser, and because the high tangential loading when the compressor wheel is rotated at the extremely high operating speeds applies very high stresses to the compressor wheel. Accordingly, so-called "boreless" compressor wheels have been proposed, in which only a relatively short threaded blind bore is provided in the compressor wheel to provide a threaded connection with corresponding thread on the shaft. Such a compressor wheel is disclosed in, for example, U.S. Pat. Nos. 4,705,463 and 4,986,733.

However, in view of the very high rotating speeds to which compressor wheels are subjected, it is absolutely necessary that the rotating assembly be dynamically balanced. This is possible only if the shaft and compressor wheel rotate about a common axis. Accordingly, it is extremely important to maintain the concentricity between the shaft and the compressor wheel within relatively tight limits. Prior art attachments of boreless compressor wheels to the rotating shaft relied upon the threads connecting the compressor wheel to the shaft to maintain the required concentricity. However, the clearance inherent in a threaded connection makes maintenance of the required degree of concentricity difficult.

The present invention solves the aforementioned problem by using axially spaced sets of pilot surfaces on the shaft and bore of the compressor wheel to maintain concentricity. This allows the threads to serve only the function of attaching the compressor wheel to the shaft, instead of requiring the threaded connection to both attach the compressor wheel to the shaft and also to maintain concentricity therebetween. The sets of piloting surfaces are located on opposite sides of the threaded section of the shaft and bore, and are offset radially from the threads. Accordingly, the piloting function is separate from the threads, to thereby maintain the required concentricity between the compressor wheel and the shaft.

Figure 2:
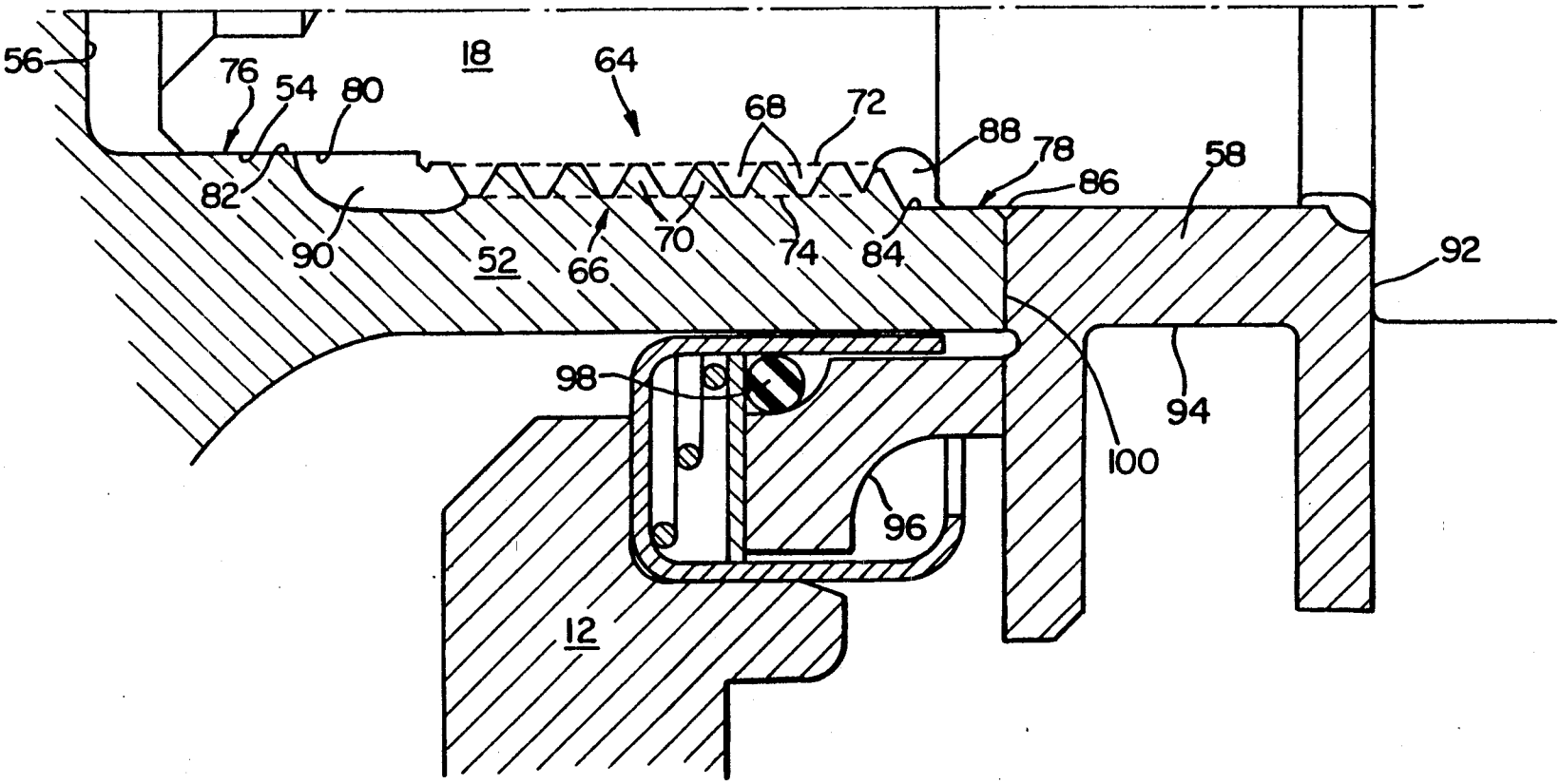

These and other advantages of the present invention will become apparent from the following description, with reference to the accompanying drawings, in which;

FIG. 1 is a cross-sectional view of a turbocharger including a compressor wheel and shaft assembly made pursuant to the teachings of the present inventions; and FIG. 2 is an enlarged, fragmental view of the lower one-half of the circumscribed portion of FIG. 2.

Referring now to the drawings, a turbocharger generally indicated by the numeral 10 includes a conventional center housing 12 in which axially spaced bearings 14, 16 support a shaft 18 for rotation relative to the housing 12. A turbine wheel generally indicated by the numeral 20 includes blades 22 projecting therefrom. Turbine wheel 20 is secured to one end of the shaft 18. A turbine housing 24 encloses the turbine wheel 20 and defines divided volute passages 26, 28 therewithin which communicate exhaust gases from the exhaust manifold of the vehicle upon which the turbocharger 10 is used to the blades 22 of the turbine wheel 20. After passing through the blades 22, exhaust gases are discharged from the turbocharger 10 through outlet 30.

A compressor wheel generally indicated by the numeral 32 is mounted on the other end of the shaft 18 via a threaded connection generally indicated by the numeral 34 which will be described in detail hereinafter. The compressor wheel 32 is enclosed within a compressor housing generally indicated by the numeral 36 which is secured to the center housing 12 and which defines an inlet 38 and an outlet volute passage 40 which terminates in an outlet connection 42. Outlet connection 42 is communicated with the intake manifold of the engine upon which the turbocharger 10 is used. As is well know to those skilled in the art, rotation of the compressor wheel 32 by exhaust gases acting through the turbine wheel 22 draws air through the inlet 38, compresses the air as it moves through the compressor wheel 32, and discharges the compressed air into the outlet volute passage 40.

Compression of the air by the compressor wheel 32 is effected by aerodynamic blades 44 carried on hub portion 46 of compressor wheel 32. Although the compressor blades 44 are illustrated in simple schematic projection, they are in reality complexly curved, very thin blades which have been designed for optimum aerodynamic efficiency. The blades 44 extend toward nose portion 48 of compressor wheel 32 from back disc portion 50 of hub 46. A mounting sleeve 52, which is an integral part of the hub 46, projects from the end of the latter which is opposite the nose 48. Mounting sleeve 52 defines a blind bore 54 therewithin which will be more completely described with reference to FIG. 2.

It will be noted that the back disc 50 represents the largest diameter of the compressor wheel 32. Since the stresses induced on the compressor wheel at operating speeds are a function of the diameter of the rotating body, the maximum stresses induced in the compressor wheel will be at a plane P which extends transversely with respect to the axis of the compressor wheel 32 and shaft 18. As clearly shown in FIG. 1, the closed end 56 of the blind bore 54 within the mounting sleeve 52 which provides the threaded attachment with the shaft 18 is substantially to the right (viewing FIG. 1) of the plane P where maximum centrifugal stresses will be induced on the compressor wheel 32. Since the bore does not penetrate this plane, the boreless compressor wheel 32 will have a substantially longer fatigue life than conventional compressor wheels in which a bore extends all the way through hub 46 and through the nose 48. The turbocharger 10 further includes a thrust collar 58 which rotates with the shaft 18 and which is engaged by a non-rotating thrust bearing 60 which is carried in the center housing 12. Oil passages 62 communicate lubricating oil to the bearings 14, 16 and 60.

Referring to FIG. 2, the threaded connection 34 between the blind bore 56 and the shaft 18 comprises a shaft threaded section 64 and a bore threaded section 66 which engages the shaft threaded section 64 when the compressor wheel 32 is installed on the shaft 18. The threaded section 64 consists of shaft threads generally indicated by the numeral 68, and the threaded section 66 consists of bore threads generally indicated by the numeral 70. It will be noted that the threads 68 on shaft 18 extend from a root diameter defined by a minor diameter 72 out to a major diameter 74 and that threads 70 on the bore 56 extend from a root diameter defined by major diameter 74 to the inward to a minor diameter 72. The circumferentially extending, annular region between the diameters 72, 74 defines a thread engagement region.

A first set of mutually cooperating pilot surfaces generally indicated by the numeral 76 is separated from a second set of mutually cooperating pilot surfaces 78 by the threaded sections 64, 66. The set 76 includes a circumferentially extending, substantially smooth shaft pilot surface 80 and a corresponding circumferentially extending, substantially smooth bore pilot surface 82 which is designed to closely engage the pilot surface 80. It will be noted that the set 76 is displaced radially inwardly out of the threaded engagement region defined between the diameters 72, 74. The second set of pilot surfaces 78 is displaced radially outwardly from the engagement region defined between the diameters 72, 74. The relative radial displacement between the sets of pilot surfaces assures separation of the piloting function performed by the pilot sets 76, 78, and the attachment functions, provided by the threads 68, 70. Without either or both of the pilot sets 76, 78, the threads would perform an undesirable piloting function, and it would be much more difficult to assure concentricity between the compressor wheel and the shaft. The pilot set 78 consists of a circumferentially extending substantially smooth pilot surface 84 on the bore 56 and a similar substantially smooth circumferentially extending surface 86 on the shaft 18. All pilot surfaces 80, 82, 84, 86 extend coaxially with respect to the bore 56 and shaft 18.

A circumferentially extending gap 88 between the shaft 18 and the wall of the bore 56 extends between the second set of pilot surfaces 78 and the threaded sections 64, 66. The gap 88 assures that thread stresses will not be transmitted to the pilot surfaces 78, and further assures that the set of pilot surfaces 78 is structurally separate from the threads 68, 70, to enable the pilot surfaces 84, 86 to engage one another when the assembler installs the compressor wheel on the shaft while maintaining concentricity therebetween. Another gap 90 extends circumferentially between the shaft and the wall of the bore and extends axially between the set of pilot surfaces 76 and the threads 68, 70. The gap 90 not only performs the function of the gap 88 in separating thread stresses and maintaining physical separation between the set of pilot surfaces 76 and the threads, but also prevents transmission of centrifugal stresses acting on the compressor wheel 32 due to rotation thereof to the threads 68.

The thrust collar 58 engages a shoulder 92 on the shaft 18 and is provided with a groove 94 which receives the thrust bearing 60 and is also provided with a face seal 96 carrying a circumferentially extending secondary seal 98 which engages the housing 12 to prevent oil leakage out of the housing. The thrust collar 58 also defines a circumferentially extending, radially projecting stop surface 100 which engages the end of the mounting sleeve 52 to provide a positive stop for the compressor wheel when the latter is threaded on the shaft 18.

We claim:

1. Compressor wheel and shaft assembly comprising a rotatable shaft having threads comprising a shaft threaded section adjacent one end thereof, a pair of circumferentially extending, substantially smooth shaft pilot surfaces defined on said shaft, each of said shaft pilot surfaces being located adjacent a corresponding end of the shaft threaded section, and a compressor wheel rotatable about an axis, said compressor wheel having an axially extending bore receiving said shaft and threads comprising a bore threaded section within said bore for engagement with the threads of the shaft threaded section when the compressor wheel is installed on the shaft, said bore having a pair of circumferentially extending, substantially smooth bore pilot surfaces adjacent corresponding ends of said bore threaded section for engagement with a corresponding shaft pilot surface to define a pair of axially separated sets of mutually cooperating pilot surfaces, each of the pilot surfaces extending coaxially with respect to said bore, an annular thread engagement region defined between a minor diameter defined by the root diameter of the threads comprising said shaft threaded section and a major diameter defined by the root diameter of the threads comprising said bore threaded section when the compressor wheel is installed on said shaft, each of said sets of cooperating pilot surfaces being displaced radially with respect to said thread engagement region, said shaft carrying a radially projecting, circumferentially extending stop surface cooperating with a corresponding radially projecting, circumferentially extending stop surface on said compressor wheel to thereby locate said compressor wheel axially relative to said shaft.

2. Compressor wheel and shaft assembly as claimed in claim 1, wherein a circumferentially extending gap is defined between said bore and the portion of the shaft received within said bore, said gap extending axially between one of said sets of cooperating pilot surfaces and corresponding ends of the threaded sections on the bore and on the shaft.

3. Compressor wheel and shaft assembly as claimed in claim 1, wherein a pair of circumferentially extending gaps are defined between said bore and the portion of the shaft received within said bore, one of said gaps extending axially between one of said sets of cooperating pilot surfaces and the corresponding end of the threaded sections on the bore and on the shaft, the other gap extending axially between the other set of cooperating pilot surfaces and the other end of the threaded section on the bore and on the shaft.

4. Compressor wheel and shaft assembly comprising a rotatable shaft having threads comprising a shaft threaded section adjacent one end thereof, a pair of circumferentially extending, substantially smooth shaft pilot surfaces defined on said shaft, each of said shaft pilot surfaces being located adjacent a corresponding end of the shaft threaded section, and a compressor wheel rotatable about an axis, said compressor wheel having an axially extending bore receiving said shaft and threads comprising a bore threaded section within said bore for engagement with the threads of the shaft threaded section when the compressor wheel is installed on the shaft, said bore having a pair of circumferentially extending, substantially smooth bore pilot surfaces adjacent corresponding ends of said bore threaded section for engagement with a corresponding shaft pilot surface to define a pair of axially separated sets of mutually cooperating pilot surfaces, each of the pilot surfaces extending coaxially with respect to said bore, an annular thread engagement region defined between a minor diameter defined by the root diameter of the threads comprising said shaft threaded section and a major diameter defined by the root diameter of the threads comprising said bore threaded section when the compressor wheel is installed on said shaft, each of said sets of cooperating pilot surfaces being displaced radially with respect to said thread engagement region, said compressor wheel including a hub extending between a nose on one end thereof and amounting sleeve on the other end, said bore being a blind bore having an open end receiving said shaft, said blind bore extending into said mounting sleeve and terminating in a closed end plane, said compressor wheel further including a back disc extending radially from said hub and compressor blades extending between said back disc and said nose, said compressor wheel having its largest diameter at the transverse plane defined by said back disc, said closed end plane being located between said open end and the transverse plane defined by said back disc.

5. Turbocharger comprising a housing, means for rotatably supporting a shaft within said housing, a compressor wheel mounted on one end of the shaft and a turbine wheel mounted on the other end of the shaft, means for communicating exhaust gasses through said turbine wheel and ambient air through said compressor wheel whereby said turbine wheel reacts to aid exhaust gasses to rotate said shaft and the compressor wheel mounted on aid shaft, said shaft having threads comprising a shaft threaded section adjacent one end thereof, a pair of circumferentially extending, substantially smooth shaft pilot surfaces defined on said shaft, each of said shaft pilot surfaces being located adjacent a corresponding end of the shaft threaded section, said compressor wheel having an axially extending bore receiving said one end of the shaft and threads comprising a bore threaded section within said bore for engagement with the threads of the shaft threaded section, said bore having a pair of circumferentially extending, substantially smooth bore pilot surfaces adjacent corresponding ends of said bore threaded section for engagement with a corresponding shaft pilot surface to define a pair of axially separated sets of mutually cooperating pilot surfaces, each of the pilot surfaces extending coaxially with respect to said bore, an annular thread engagement region defined between a minor diameter defined by the root diameter of the threads comprising said shaft threaded section and a major diameter defined by the root diameter of the threads comprising said bore threaded section when the compressor wheel is installed on said shaft, each of said sets of cooperating pilot surfaces being displaced radially with respect to said thread engagement region, said shaft carrying a radially projecting, circumferentially extending shaft stop surface for engagement with a corresponding radially projecting, circumferentially extending compressor wheel stop surface on said compressor wheel to thereby locate said compressor wheel axially relative to said shaft, each of said stop surfaces projecting from a corresponding pilot surface on the compressor wheel and on the shaft respectively.

6. Turbocharger as claimed in claim 5, wherein said shaft carries a thrust collar rotatable with said shaft and engaged with a nonrotatable thrust bearing carried by said housing for locating said shaft axially relative to said housing, said shaft stop surface being defined on said thrust collar.

7. Turbocharger comprising a housing, means for rotatably supporting a shaft within said housing, a compressor wheel mounted on one end of the shaft and a turbine wheel mounted on the other end of the shaft, means for communicating exhaust gasses through said turbine wheel and ambient air through said compressor wheel whereby said turbine wheel reacts to said exhaust gasses to rotate said shaft and the compressor wheel mounted on said shaft, said shaft having threads comprising a shaft threaded section adjacent one end thereof, a pair of circumferentially extending, substantially smooth shaft pilot surfaces defined on said shaft, each of said shaft pilot surfaces being located adjacent a corresponding end of the shaft threaded section, said compressor wheel having an axially extending bore receiving said one end of the shaft and threads comprising a bore threaded section within said bore for engagement with the threads of the shaft threaded section, said bore having a pair of circumferentially extending, substantially smooth bore pilot surfaces adjacent corresponding ends of said bore threaded section for engagement with a corresponding shaft pilot surface to a define a pair of axially separated sets of mutually cooperating pilot surfaces, each of the pilot surfaces extending coaxially with respect to said bore, an annular thread engagement region defined between a minor diameter defined by the root diameter of the threads comprising said shaft threaded section and a major diameter defined by the root diameter of the threads comprising said bore threaded section when the compressor wheel is installed on said shaft, each of said sets of cooperating pilot surfaces being displaced radially with respect to said thread engagement region, wherein aid compressor wheel includes a hub extending between a nose on one end thereof and a mounting sleeve on the other end, said bore being a blind bore having an open end receiving said shaft, said blind bore extending into said mounting sleeve and terminating in a closed end plane, said compressor wheel further including a back disc extending radially from said hub and compressor blades extending between said back disc and said nose, said compressor wheel having its largest diameter at the transverse plane defined by said back disc, said closed end plane being located between said open end and the transverse plane defined by said back disc.

8. Turbocharger as claimed in claim 7, wherein one of said sets of cooperating pilot surfaces is displaced radially inwardly with respect to said thread engagement region and the other set of cooperating pilot surfaces is displaced radially outwardly from said thread engagement region.

9. Turbocharger as claimed in claim 7, wherein a circumferentially extending gap is defined between said bore and the portion of the shaft received within said bore, said gap extending axially between one of said sets of cooperating pilot surfaces and corresponding ends of the threaded sections on the bore and on the shaft.

10. Turbocharger as claimed in claim 7, wherein a pair of circumferentially extending gaps are defined between said bore and the portion of the shaft received within said bore, one of said gaps extending axially between one of said sets of cooperating pilot surfaces and the corresponding end of the threaded sections on the bore and on the shaft, the other gap extending axially between the other set of cooperating pilot surfaces and the other end of the threaded section on the bore and on the shaft.

* * * * *